United States Patent [19]

Lancaster, III et al.

[11] Patent Number: 5,048,261

[45] Date of Patent: Sep. 17, 1991

[54] TOP SHEET DISPENSER FOR A STRETCH WRAPPING APPARATUS

[75] Inventors: Patrick R. Lancaster, III; John Fain; Kenneth J. McDowell, Jr., all of Louisville, Ky.

[73] Assignee: Lantech, Inc., Louisville, Ky.

[21] Appl. No.: 407,094

[22] Filed: Sep. 14, 1989

[51] Int. Cl.[5] ..... B65B 11/04

[52] U.S. Cl. ..... 53/399; 53/441; 53/587

[58] Field of Search ..... 53/556, 587, 588, 176, 53/389, 210, 399, 441

[56] References Cited

U.S. PATENT DOCUMENTS

| | | | |
|---|---|---|---|
| 3,540,187 | 11/1970 | Monaghan | 53/210 X |
| 3,910,005 | 10/1925 | Thimon | 53/588 X |
| 4,063,401 | 12/1977 | Higgins | 53/567 |
| 4,232,501 | 11/1980 | Stackhouse | 53/587 |
| 4,300,326 | 11/1981 | Stackhouse | 53/587 |
| 4,450,668 | 5/1984 | Crossi | 53/587 X |
| 4,691,498 | 9/1987 | Stamm | 53/589 X |
| 4,735,033 | 4/1988 | Stackhouse | 53/587 |

FOREIGN PATENT DOCUMENTS

| | | | |
|---|---|---|---|
| 3344940 | 6/1985 | Fed. Rep. of Germany | 53/556 |
| 2057386 | 4/1981 | United Kingdom | 53/580 |

*Primary Examiner*—John Sipos

*Attorney, Agent, or Firm*—Finnegan, Henderson, Farabow, Garrett & Dunner

[57] ABSTRACT

A method and apparatus for dispensing a top sheet and stretch wrapping includes a dispenser for dispensing a sheet from a roll of sheet material and a trough for receiving, containing and collapsing the dispensed sheet. A circulating bar draws the dispensed sheet from the trough over the top of a load by moving from a starting position to a finishing position above and across the top of the load while another bar returns from the finishing position to the starting position to position the dispensed sheet proximate to a hot wire which severs the sheet from the roll from which it is dispensed. A suspended flexible strip rests on top of the load for holding the sheet in place on top of the load. The trough, circulating bars and depending flexible strip are mounted on a frame which is movable in the vertical direction. A film web dispenser dispenses a web from a roll or sheet material and stretches the web, and a turntable rotates the load relative to the film web dispenser for wrapping the film web on the load and around the edges of the dispensed top sheet.

20 Claims, 9 Drawing Sheets

TOP SHEET DISPENSER FOR A STRETCH WRAPPING APPARATUS

BACKGROUND OF THE INVENTION

The present invention relates to packaging, and more particularly to a device for dispensing a top sheet to cover the top of a load in a stretch wrapping process.

Machines which wrap the sides of a load with a web of stretched material to cover and contain the load are generally known as stretch wrapping machines. Examples of such machines are disclosed in U.S. Pat. Nos. 4,232,501, 4,300,326 and 4,735,033 to Stackhouse and assigned to Lantech, Inc. These patents and the U.S. patents cited in these references are incorporated herein by reference.

If it is desirable to cover the top of the load in a mechanized way, additional components are added to the stretch wrapping machines. Such components dispense and position a sheet of material over the top of the load and hold it in place while it is secured in position.

A number of techniques have been used to cove the top of a load. In one technique, a roll of film is supported on a frame above the load. The leading end of the film is pulled in a horizontal direction with a gripper to unwind a web of film from the roll and position the web across the top of the load. A platen above the severed web is lowered, holding the web against the top of the load and the trailing end of the web is severed, leaving a top sheet on the load to be secured by further stretch wrapping its periphery to the sides of the load or by another manner.

This technique involves a substantial number of additional mechanical components which are expensive to manufacture, such as the gripper and the platen. The effective operation of the gripper is complex and requires high precision to obtain reliability. The cycling time for dispensing the film from the roll, the gripper movement across the top of the load and the movement of the platen substantially slows the wrapping process.

Another conventional technique is to dispense the web of film from the film roll so that it hangs vertically from the film roll and is drawn over the top of the load by a bar which circulates horizontally over the top of the load. This technique reduces the complexity required by the gripper technique. However, having dispensed and exposed the film from the roll before drawing it over the top of the load, and reversing its orientation from a vertical plane to a horizontal plane, increases the likelihood that the film will be twisted, bunched or snagged by the time it is positioned on top of the load, rendering it unusable.

Accordingly, it is an object of the present invention to overcome these drawbacks and provide a device which covers the top of the load with a top sheet, in a simple, quick, inexpensive and reliable manner.

Additional advantages of the invention are set forth in part in the description which follows, and in part will be obvious from the description, or may be learned by practice of the invention. The objects and advantages of the invention may be realized and attained by means of the instrumentalities and combinations particularly pointed out in the appended claims.

SUMMARY OF THE INVENTION

To achieve the foregoing objects, and in accordance with the purposes of the invention as embodied and broadly described herein, there is provided a top sheet dispenser comprising means for dispensing a sheet from a roll of sheet material, means for receiving and containing the dispensed sheet, and means for drawing the dispensed sheet from the receiving and containing means over the top of a load.

The drawing means includes a plurality of means for engaging the sheet and means for moving one engaging means from a starting position to a finishing position above and across the top of the load for drawing the dispensed sheet over the top of the load while returning another engaging means from the finishing position to the starting position. A suspended flexible member rests on the top of the load for holding the sheet in place on the top of the load.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DESCRIPTION OF THE PREFERRED EMBODIMENT

Reference will now be made in detail to the present preferred embodiment of the present invention, as illustrated in the accompanying drawings.

Figure 1:
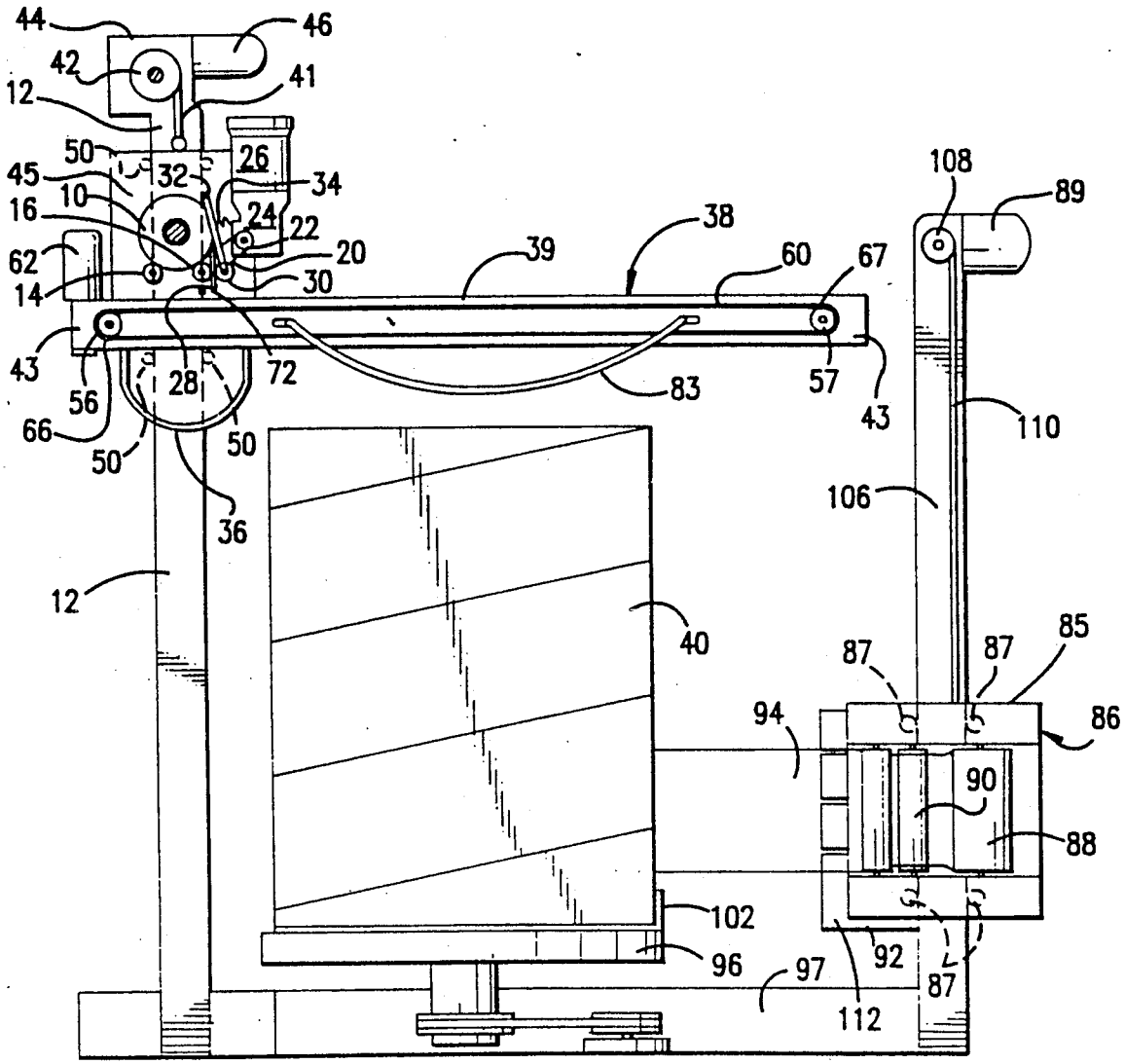
FIGS. 1–8 are side elevation views in partial section of a top sheet dispenser in accordance with the teachings of the present invention at various stages in its operation.
Figure 9:
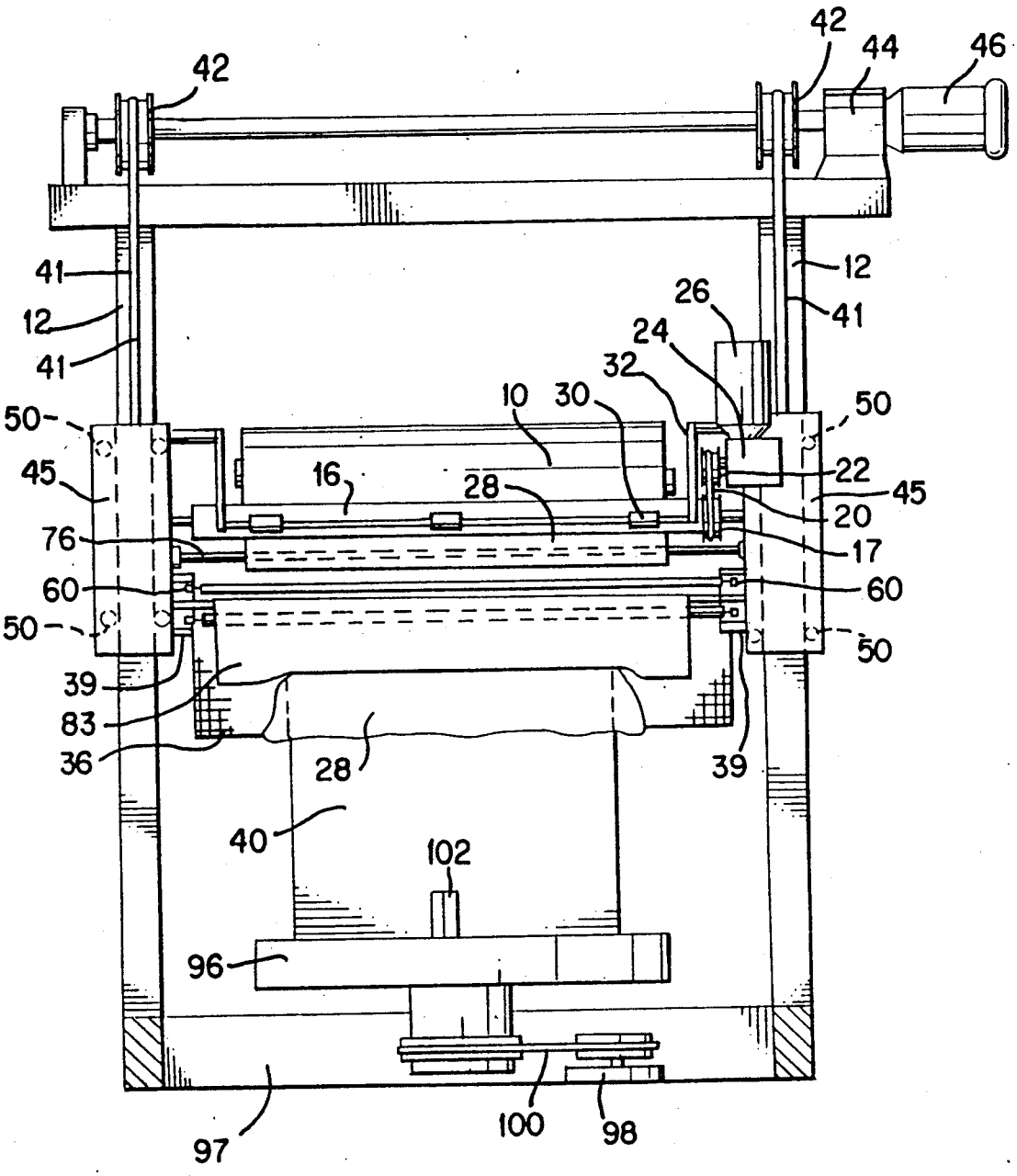
FIG. 9 is a front view in partial section of the arrangement shown in FIG. 8.

In accordance with the present invention, there is provided a top sheet dispenser for a stretch wrapping apparatus comprising means for dispensing a sheet from a roll of sheet material. As embodied herein and as shown in FIGS. 1 and 9, the dispensing means comprises idler roller 14 and driven roller 16 disposed to support a roll 10 of sheet material 28. Driven roller 16 is provided with a sprocket 17 for engaging chain 20. Chain 20 connects that sprocket with sprocket 22. Sprocket 22 is driven by motor 26 through reducer 24.

Figure 2:
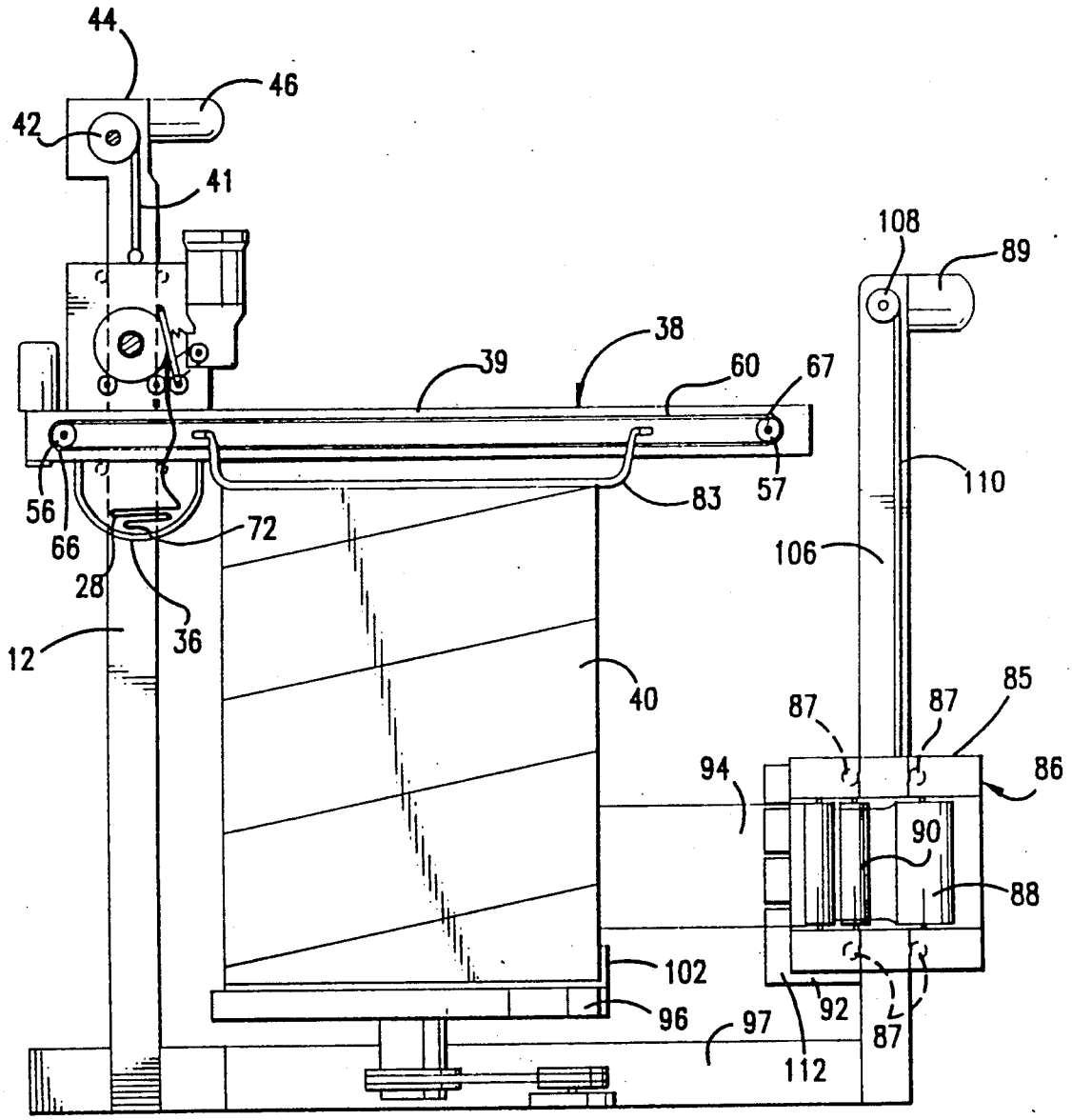

As shown in FIGS. 1 and 2, sheet material 28 is guided off of the roll 10 between the driven roller 16 and a spring loaded roller 30. Spring loaded roller 30 is rotatably attached to the lower end of arm 32 which pivots about its upper end. Arm 32 is urged by spring 34 to hold sheet material 28 in engagement with driven roller 16.

Figure 3:
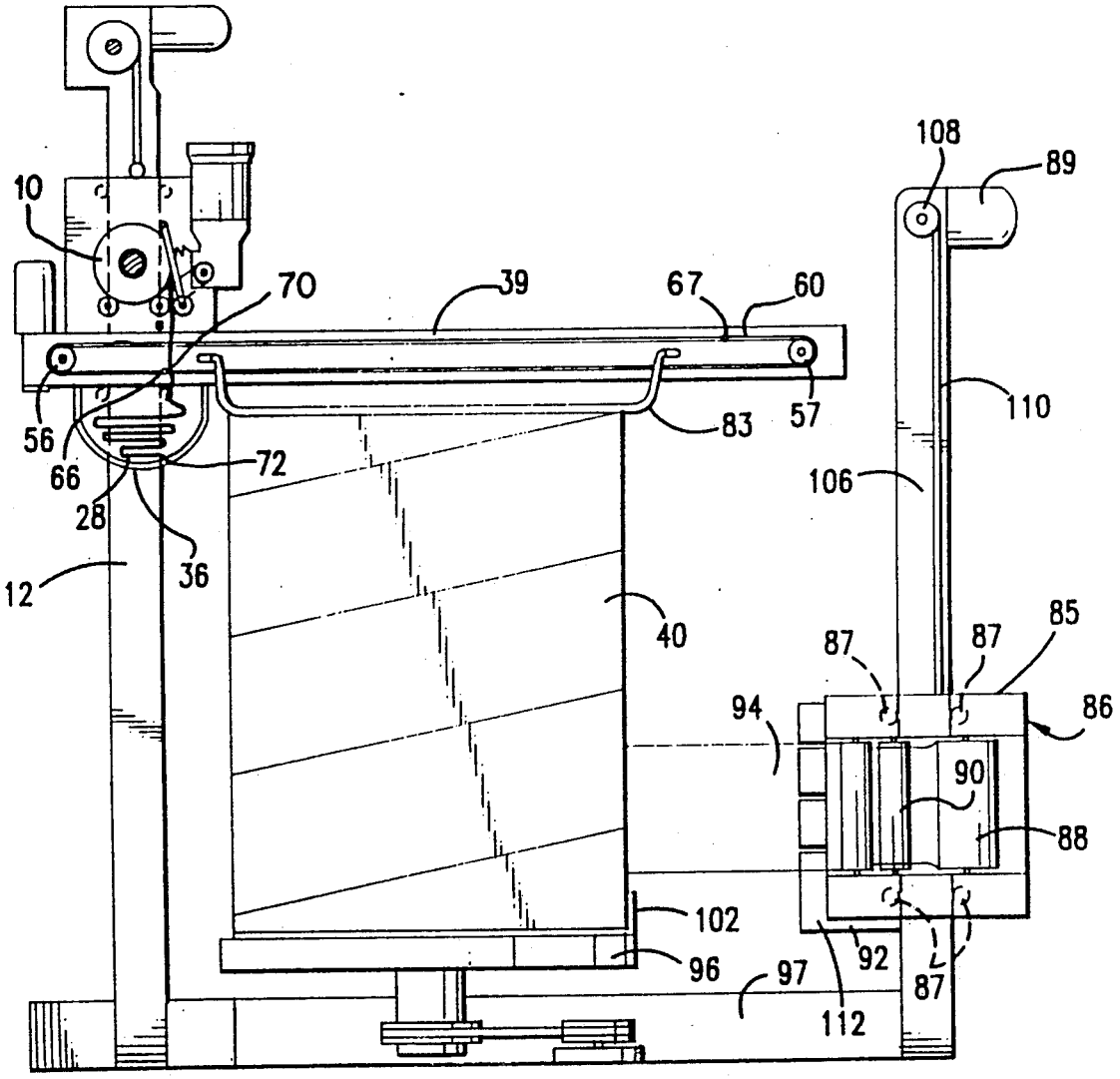
Figure 4:
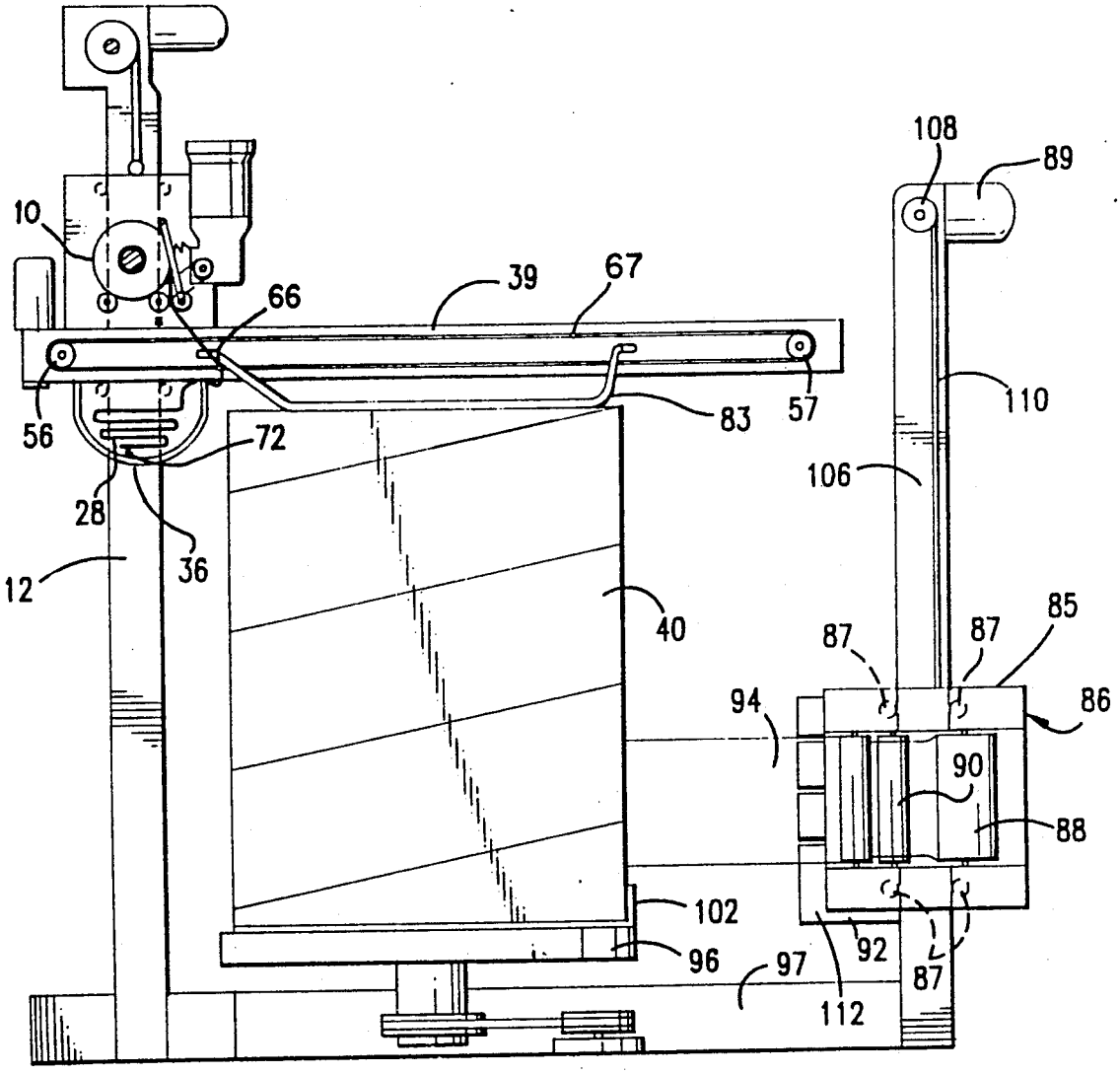
Figure 5:
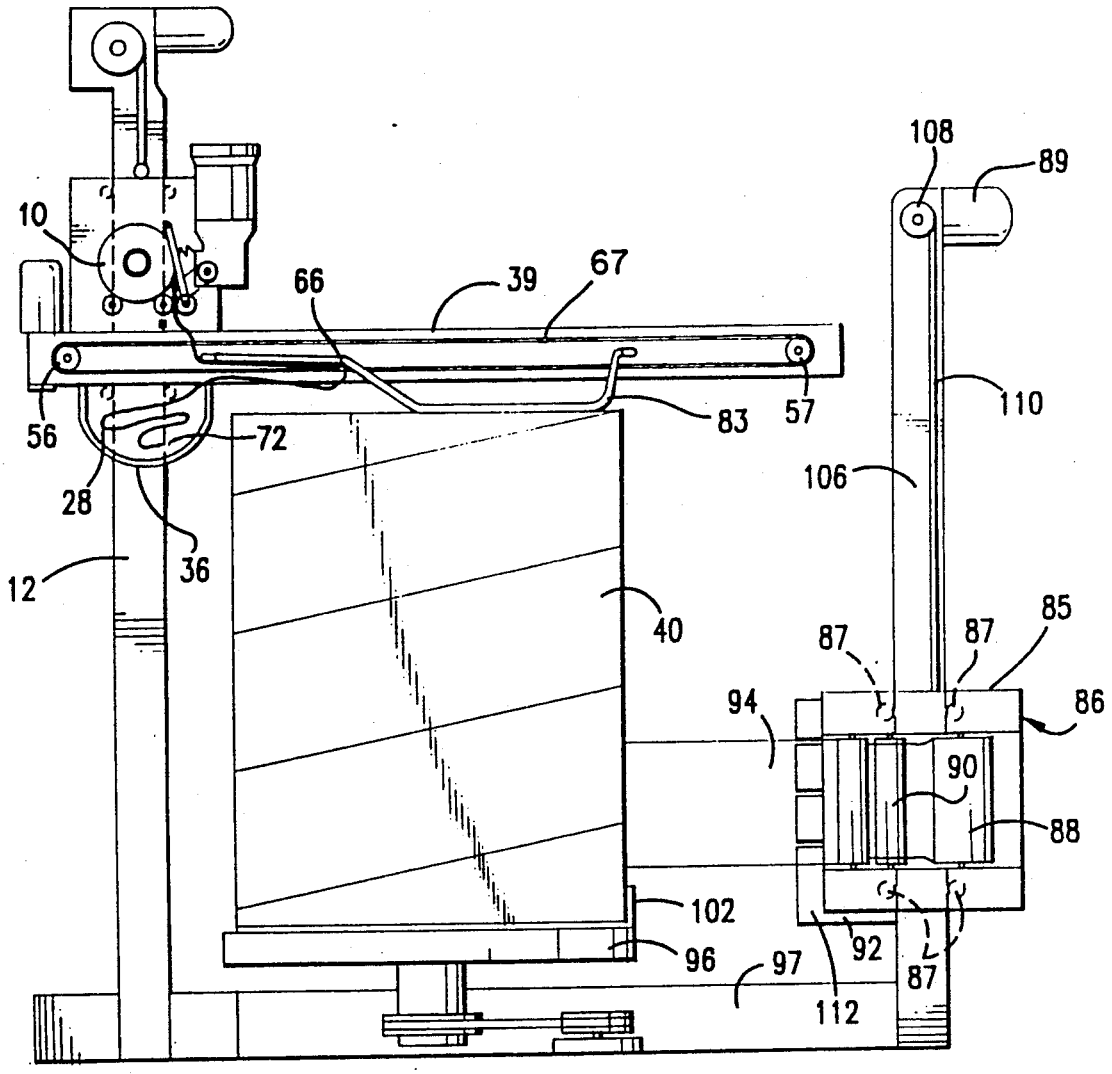
Figure 6:
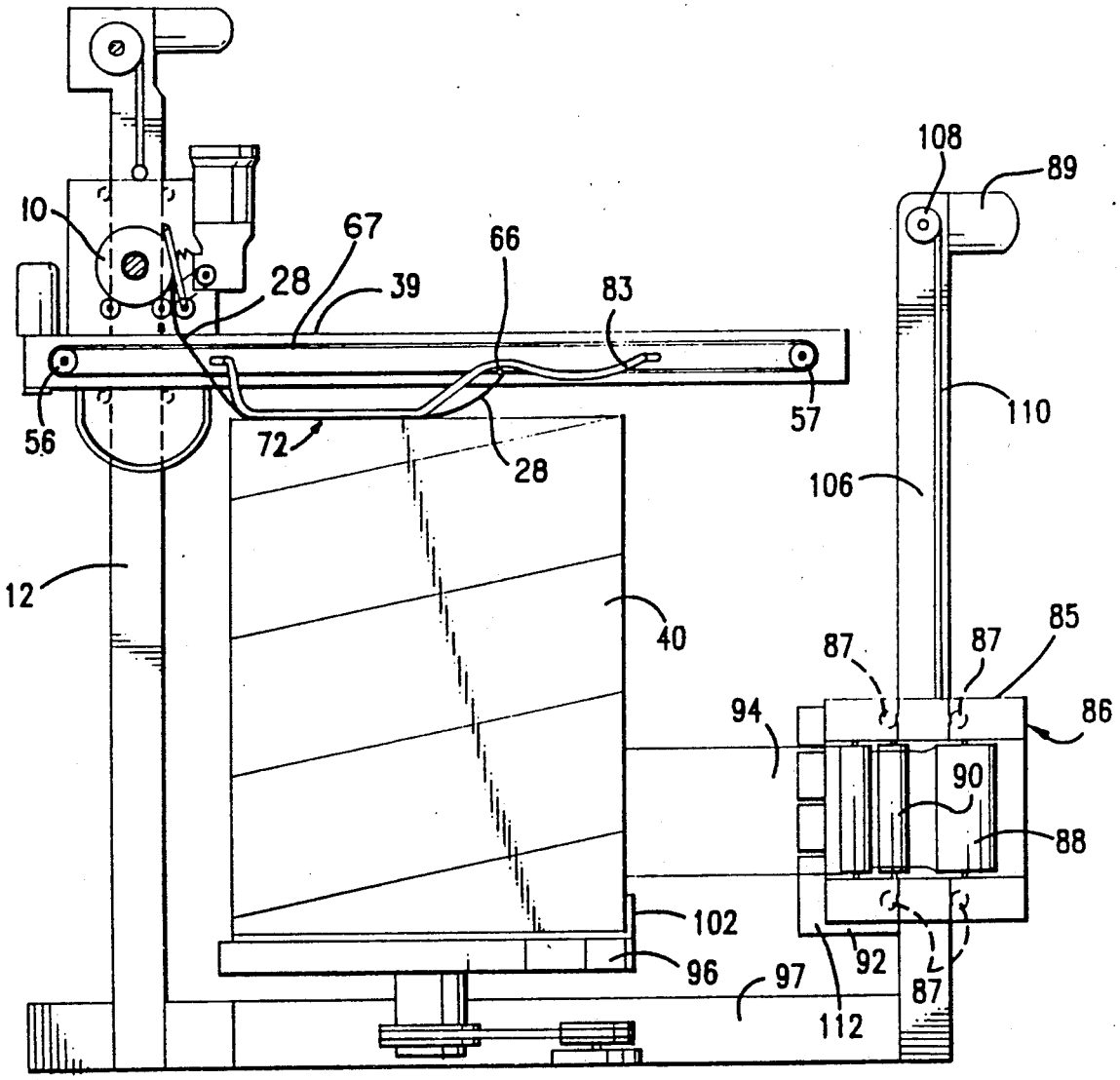

In accordance with the present invention, the top sheet dispenser is also provided with a means for receiving and containing the dispensed sheet. It is preferable that the receiving and containing means includes a means for collapsing the dispensed sheet. As shown in FIG. 1, the receiving and containing means includes a mesh trough 36, which extends across the width of sheet 28 and located below the roll 10 of sheet material 28 and roller 14 and 16. As can be seen by the sequence of FIGS. 1–3, as roll 10 is unrolled, sheet material 28 is received and contained in trough 36, and collapses upon itself. Other receiving and containing means can include, for example, a pair of vertically extending planar members between which sheet material 28 can be dispensed and contained, shielding it from air currents which would otherwise twist or displace sheet material 28.

In accordance with the present invention, the top sheet dispenser is provided with a means for drawing the dispensed sheet from the receiving and containing means over the top of a load. The drawing means preferably includes a plurality of means for engaging the sheet and means for moving one engaging means from a starting position to a finishing position above and across the top of the load for drawing the dispensed sheet over the top of the load while returning another engaging means from the finishing position to the starting position.

As shown in FIG. 1, the plurality of engaging means includes bars 66 and 67 and the moving means includes a pair of spaced endless chains 60. Chains 60 are supported by sprockets 56 and 57 and driven by motor and reducer 62.

A frame 38 supports the components which dispense and collapse sheet material 28, and the components which draw sheet material 28 over the top of the load. Frame 38 includes a parallel pair of spaced horizontal beams 39. Each beam 39, supports one set of sprockets 56 and 57 and may also include a track along the path of one of the chains 60 to support the chain and the end of bars 66 and 67 which are carried by that chain. Beams 39 are connected at their ends by a second parallel pair of spaced horizontal beams 43 to form a rectangular configuration of beams 39 and 43 as seen from above. In addition, frame 38 includes support plates 45 which carry the components which draw sheet material 28 over the top of the load.

Frame 38 in turn is movably attached to vertical support member 12 through a sliding bearing, which includes roller wheels 50 located on support plates 45 to slidably engage the vertical support member 12. Frame 38 is positioned in the vertical direction by a cable 41 which is reeled in and out by a capstan 42 disposed at the top of vertical support member 12. Capstan 42 is driven by motor 44 through reducer 46.

As shown in the sequence of FIGS. 2-3, bar 66 is transported by chains 60 to engage a surface of the dispensed top sheet material 28 at a point 70 between the roll 10 and the free end 72. As shown in the sequence of FIGS. 2-8, bar 66 circulates about its endless path around sprockets 56 and 57 from a starting position on the left to a finishing position on the right in a counter-clockwise direction. In doing so, it draws top sheet material 28 from trough 36 over the top of load 40. As bar 66 moves across the top of load 40 from left to right, bar 67 moves from right to left, from the finishing position to the starting position.

Figure 7:
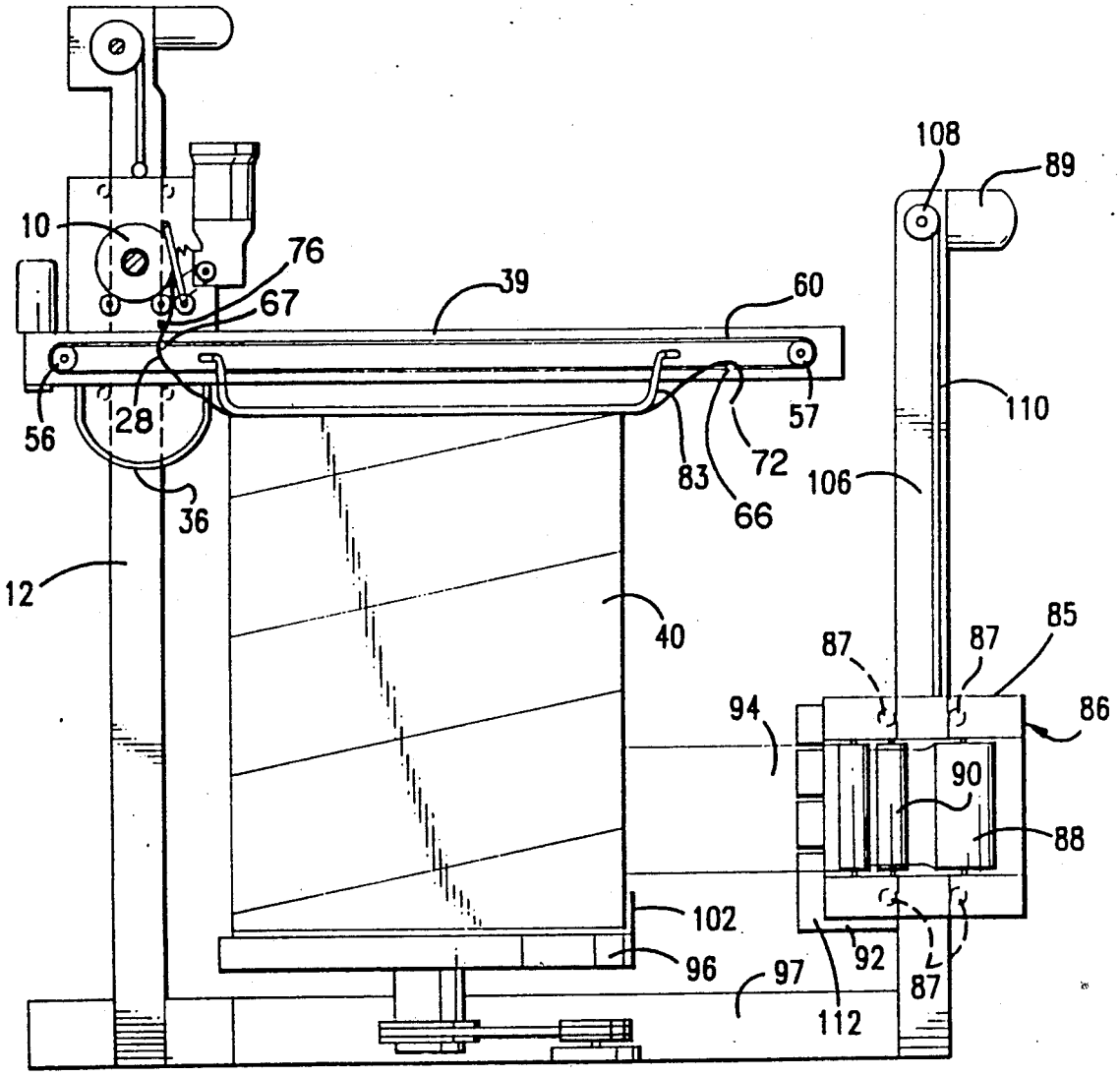
Figure 8:
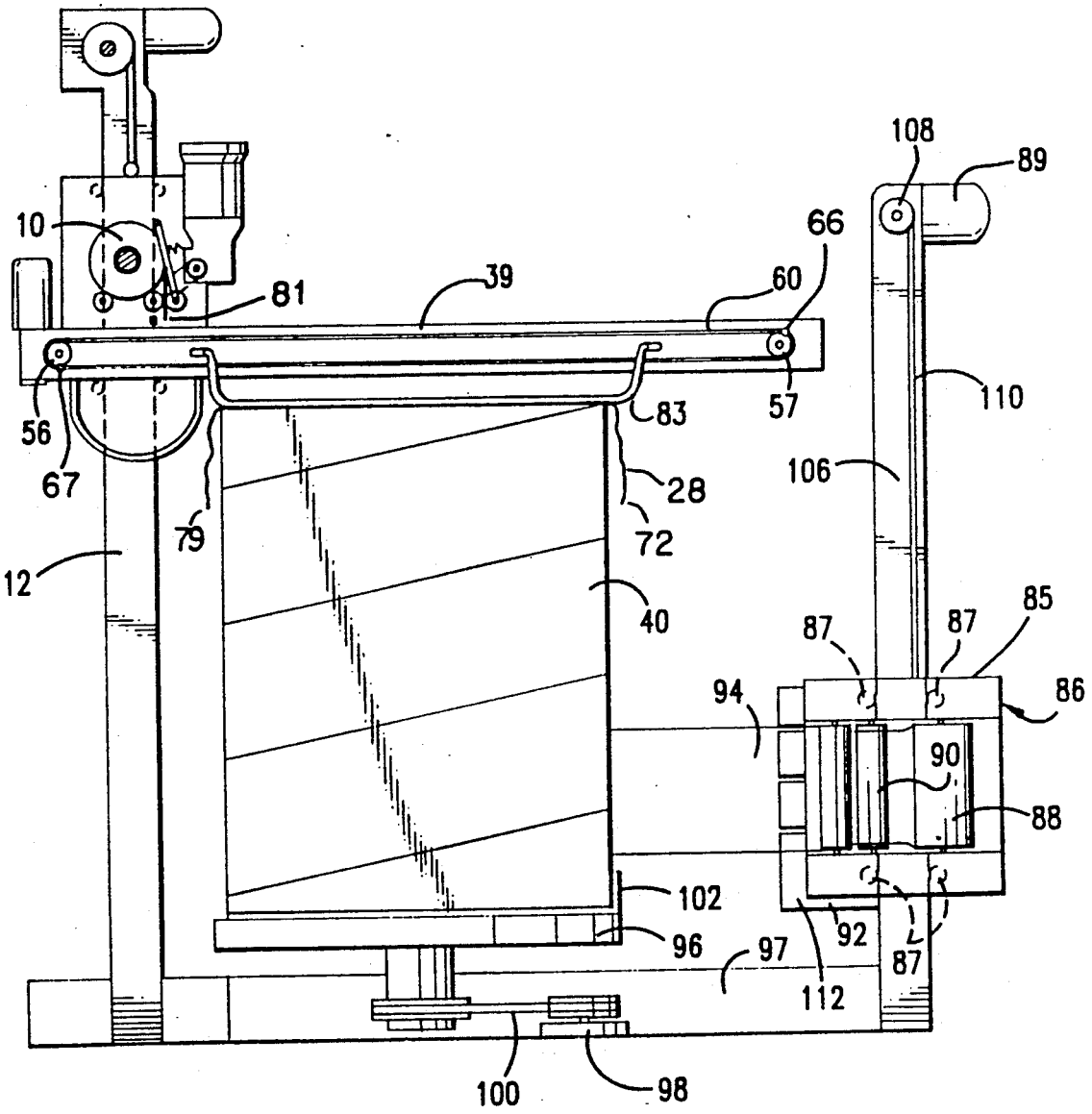

As depicted in FIG. 7, after bar 66 has transported sheet material 28 across the top of load 40 so that the free end 72 of the sheet material 28 is hanging over the edge of load 40, bar 67 pushes a portion of sheet material 28 proximate sheet roll 10 against severing means such as hot wire 76 to sever the dispensed sheet of material 28 from roll 10 at line 78. As shown in FIG. 8, after the severing step, edge 79 of the sheet material 28 hangs over the edge of the load 40 and edge 81 forms the new leading edge of sheet material depending from roll 10.

In accordance with a preferred embodiment of the present invention, the top sheet dispenser includes a suspended flexible member which rests on the top of the load for holding the sheet in place on the top of the load. As shown in FIG. 8 and 9, the flexible member includes a strip 83 attached at its ends to frame 38 so that its middle rests on load 40. The ends of strip 83 are attached at a location between the upper and lower runs of chains 60 through the use of rods 61. As shown in the sequence of FIGS. 2-8, contact bar 66 moves across the top of load 40, in between strip 83 and top of the load 40. Strip 83 holds the sheet material 28 in contact with bar 66 and the top of load 40 during the process of drawing sheet 28 over the top of load 40 shown in FIGS. 3-8. Strip 83 also holds sheet material 28 in contact with the top of load 40 after the process of drawing sheet 28 over the top of load 40, during which time the edges of dispensed and positioned sheet 28 can be stretch wrapped to the load after the drawing process, as described below.

In accordance with the present invention, there is provided means for dispensing a web from a roll of sheet material and stretching the web and means for rotating the load relative to the web dispensing means for wrapping the film web on the load.

As shown in FIG. 8, the web dispensing means is a film web dispenser 86 having a roll of stretch film 88 and prestretch rollers 90 and 92 which stretch the film dispensed from film web dispenser 86. Film web dispenser 86 includes a frame 85 with rollers 87 so as to be slidably mounted on vertical support member 106. Motor and gearbox 89 is mounted on support member 106 and drives a capstan 108 which reels cable 110 in and out to move film web dispenser 86 in the vertical direction. Such an arrangement allows film web 94 to be spirally wrapped on load 40 as load 40 rotates.

The means for rotating the load relative to the web dispensing means includes a turntable 96 which is rotatably mounted in base 97, and driven by a motor and reducer 98 through belt 100. Alternatively, the means for rotating the load relative to the web dispensing means may include an arrangement which can rotate the film web dispenser 86 around load 40 while keeping load 40 stationary.

The apparatus operates as follows. Load 40 is positioned on turntable 96. Film web 94 is positioned in clamp 102. Frame 38 is lowered from the raised position shown in FIG. 1, which allows the load 40 to be positioned on turntable 96, to a lowered position, shown in FIG. 2. Sheet material 28 is dispensed and collapsed into trough 36 as shown in the sequence of FIGS. 1-3.

Turntable 96 is rotated, stretching and wrapping film web 94 on sides of rotating load 40. Film web dispenser 86 is lowered from the top area of load 40.

Sheet 28 is drawn from trough 36 over the top of load 40 by bar 66 and held in place on the top of the load by strip 83. Bar 67 returns to position sheet 28 against hot wire 76, severing sheet 28 and allowing it to be disposed over the top of load 40 with its edges hanging over the top of load 40.

Turntable 96 rotates load 40 as film web dispenser 86 is again raised to wrap film web 94 over the depending edges of the top sheet which is held in place by strip 83. Turntable 96 stops rotating, film web 94 is clamped in clamp 102, cut and wiped down in a conventional manner by cutter and wipedown device 112. Frame 38 is raised and load 40 is removed from turntable 96.

Additional advantages and modifications will readily occur to those skilled in the art. The invention in its broader aspects is, therefore, not limited to the specific details, represented to apparatus and a luster to example shown and described. Accordingly, departures may be made from such details without departing from the spirit or scope of the general inventive concepts as defined by the appended claims and their equivalents.

What is claimed is:

1. A stretch wrapping apparatus comprising:

means for dispensing and forwarding a sheet from a roll of sheet material;

container means for receiving, accumulating and containing the dispensed sheet;

means for drawing the dispensed sheet from the receiving, accumulating and containing means over the top of a load said drawing means being movable relative to said dispensing and receiving means;

means for dispensing and stretching a web; and means for rotating the load relative to the web dispensing means for wrapping the web around the sides of the load.

2. The stretch wrapping apparatus of claim 1 wherein the receiving, accumulating and containing means includes a means for collapsing the dispensed sheet.

3. The stretch wrapping apparatus of claim 1 wherein the receiving, accumulating and containing means is a trough which extends across the width of the sheet.

4. The stretch wrapping apparatus of claim 1 including a frame to which the dispensing means and the receiving, accumulating and containing means are mounted, and means for positioning the frame in the vertical direction.

5. The stretch wrapping apparatus of claim 1 including a frame to which the dispensing means, the receiving, accumulating and containing means and the drawing means are mounted, and means for positioning the frame in the vertical direction.

6. The stretch wrapping apparatus of claim 1 including a suspended flexible member which rests on the top of the load for holding the sheet in place on the top of the load.

7. The stretch wrapping apparatus of claim 6 including a frame to which the dispensing means, the receiving, accumulating and containing means and the flexible member are mounted, and means for positioning the frame in the vertical direction.

8. The stretch wrapping apparatus of claim 1 wherein the drawing means includes a plurality of means for engaging the sheet and means for moving one engaging means from a starting position to a finishing position above and across the top of the load for drawing the dispensed sheet over the top of the load while returning another engaging means from the finishing position to the starting position.

9. The stretch wrapping apparatus of claim 8 including a suspended flexible member which rests on top of the load for holding the sheet in place on top of the load, a frame to which the dispensing means, the receiving, accumulating and collapsing means, the drawing means and the flexible member are mounted, and means for positioning the frame in the vertical direction.

10. The stretch wrapping apparatus of claim 1 wherein the drawing means includes means for engaging and moving the sheet, and the engaging means travels between the dispensing means and the receiving, accumulating and containing means.

11. The stretch wrapping apparatus of claim 1 wherein the drawing means includes means for engaging and moving the sheet, and the engaging means travels below the dispensing means and above the receiving, accumulating and containing means.

12. The stretch wrapping apparatus of claim 1 wherein the drawing means includes means for engaging and moving the sheet from a starting position to a finishing position above and across the top of the load and relative to the dispensing means and the receiving, accumulating and containing means.

13. The method of claim 1 wherein the drawing step includes engaging and moving the sheet from a starting position to a finishing position above and across the top of the load and relative to the dispensing means and the receiving, accumulating and containing means.

14. A method of stretch wrapping a load comprising:

dispensing and forwarding a sheet from a roll of sheet material;

receiving, accumulating and containing the dispensed sheet in a container;

drawing the dispensed sheet from the container over the top of a load;

dispensing a web from a web dispenser and stretching the web; and rotating the load relative to the web dispenser to wrap the web around the sides of the load.

15. The method of claim 14 wherein the receiving, accumulating and containing step includes collapsing the dispensed sheet.

16. The method of claim 14 including holding the sheet in place on the top of the load with a suspended flexible member which rests on top of the load.

17. The method of claim 14 wherein the drawing step includes engaging the sheet with one engaging member moving from a starting position to a finishing position above and across the top of the load while moving another engaging member from the finishing position to the starting position.

18. The method of claim 17 including holding the sheet in place on the top of the load with a suspended flexible member which rests on top of the load.

19. The method of claim 14 wherein the drawing step includes engaging and moving the sheet with an element traveling between the dispensing means and the receiving, accumulating and containing means.

20. The method of claim 14 wherein the drawing step includes engaging and moving the sheet with an element traveling below the dispensing means and above the receiving, accumulating and containing means.

* * * * *

UNITED STATES PATENT AND TRADEMARK OFFICE

CERTIFICATE OF CORRECTION

PATENT NO. : 5,048,261

DATED : September 17, 1991

INVENTOR(S) : Lancaster, III et al.

It is certified that error appears in the above-identified patent and that said Letters Patent is hereby corrected as shown below:

Claim 1, Column 5, line 11, after "load" insert --,--.

Signed and Sealed this

Twenty-sixth Day of January, 1993

*Attest:*

STEPHEN G. KUNIN

*Attesting Officer*

*Acting Commissioner of Patents and Trademarks*